US009465403B2

(12) United States Patent
Kihara

(10) Patent No.: US 9,465,403 B2
(45) Date of Patent: Oct. 11, 2016

(54) PEDAL DEVICE

(75) Inventor: Noriyasu Kihara, Takahama (JP)

(73) Assignee: DENSO CORPORATION, Kariya (JP)

( * ) Notice: Subject to any disclaimer, the term of this patent is extended or adjusted under 35 U.S.C. 154(b) by 805 days.

(21) Appl. No.: 13/166,908

(22) Filed: Jun. 23, 2011

(65) Prior Publication Data

US 2012/0011958 A1 Jan. 19, 2012

(30) Foreign Application Priority Data

Jul. 15, 2010 (JP) ..... 2010-160489

(51) Int. Cl.
*G05G 1/30* (2008.04)
*G05G 1/38* (2008.04)
*G05G 1/44* (2008.04)

(52) U.S. Cl.
CPC *G05G 1/44* (2013.01); *G05G 1/30* (2013.01); *G05G 1/38* (2013.01); *Y10T 74/20528* (2015.01)

(58) Field of Classification Search
CPC ..... G05G 1/44; G05G 1/38; G05G 1/445; G05G 1/30; Y10T 74/20528
USPC ..... 74/512–514, 560; 200/61.89, 86.5
See application file for complete search history.

(56) References Cited

U.S. PATENT DOCUMENTS 5,416,295 A * 5/1995 White et al. ..... 200/86.5
7,011,339 B2 * 3/2006 Oono et al. ..... 280/748
2004/0149070 A1 * 8/2004 Solta ..... 74/513

FOREIGN PATENT DOCUMENTS

JP 9254821 * 9/1997
JP 2007-299137 11/2007

OTHER PUBLICATIONS

Chinese Search Report issued for Chinese Patent Application No. 2011 1020 6172.0, dated Sep. 29, 2013 (with partial English translation).

* cited by examiner

*Primary Examiner* — Adam D Rogers
(74) *Attorney, Agent, or Firm* — Nixon & Vanderhye P.C.

(57) ABSTRACT

A pedal device includes a housing; a pedal arm rotatably supported by the housing; a biasing portion biasing the pedal arm; and a stopper having a contact face to contact an edge of an opening of the housing. The pedal arm passes through the opening of the housing. The stopper has a groove extending from the contact face, and the groove is inclined downward in a gravity direction, when the housing is mounted to a vehicle and when the contact face of the stopper contacts the edge of the housing.

13 Claims, 8 Drawing Sheets

PEDAL DEVICE

CROSS REFERENCE TO RELATED APPLICATION

This application is based on Japanese Patent Application No. 2010-160489 filed on Jul. 15, 2010, the disclosure of which is incorporated herein by reference in its entirety.

BACKGROUND OF THE INVENTION

1. Field of the Invention

The present invention relates to a pedal device.

2. Description of Related Art

JP-A-2007-299137 describes a pedal device to control an operation state of an engine of a vehicle in accordance with a force pressing a pedal arm of the pedal device. The pedal arm is rotatably attached to a housing and is biased by a spring in a direction opposite from a pressing direction of the pedal arm. If the pressing force is increased, the pedal arm is rotated in the pressing direction. If the pressing force is reduced, the pedal arm is rotated in the opposite direction by the biasing force of the spring.

A rotation angle of the pedal arm is detected by a rotation angle sensor that is arranged not to contact the pedal arm. A magnet is attached to the pedal arm, and generates a magnetic field. The rotation angle sensor detects a variation of magnetic flux density that is generated by a direction of the magnetic field. A signal of the detection is transmitted to an engine control unit (ECU) of the vehicle. The ECU controls a fuel injection amount or an air intake amount, for example, based on the detection signal representing the rotation angle of the pedal arm.

The pedal arm passes through an opening of the housing, and has a stopper. When a contact face of the stopper contacts an edge of the opening, the pedal arm is defined to be located at a totally-closed position. The contact face of the stopper is approximately parallel with a plane including a rotation axis of the pedal arm. Thereby, positions of the magnet and the rotation angle sensor are restricted from being deviated in a radial direction with respect to a rotation center of the pedal arm even if a manufacturing tolerance is generated in the edge of the housing and the contact face of the stopper. Therefore, a variation in the signal output from the rotation angle sensor can be reduced when the pedal arm is located at the totally-closed position.

Further, the pedal arm is secured to have play in the opening of the housing while the pedal arm is rotated in the pressing direction or the opposite direction. Therefore, the contact face of the stopper is located to be approximately perpendicular to a gravity direction when the pedal device is mounted to the vehicle. If a foreign matter such as sand is accumulated on the contact face, a gap is generated between the edge of the housing and the contact face of the stopper. In this case, the pedal arm cannot return to the totally-closed position even when a driver of the vehicle does not press the pedal arm.

While the vehicle is braked, if the pedal arm does not return to the totally-closed position, the signal indicating the totally-closed position is not output from the rotation angle sensor to the ECU. The ECU keeps the operation state of the engine in accordance with a rotation angle of the pedal arm. In this case, an unintentional controlling of the engine may be performed.

SUMMARY OF THE INVENTION

In view of the foregoing and other problems, it is an object of the present invention to provide a pedal device.

According to an example of the present invention, a pedal device includes a housing, a pedal arm, a biasing portion and a stopper. The housing is to be mounted to a vehicle. The pedal arm is rotatably supported by the housing and to be pressed by a driver of the vehicle in a pressing direction. The pedal arm passes through an opening of the housing. The biasing portion biases the pedal arm in an opposite direction opposite from the pressing direction. The stopper has a contact face to contact an edge of the opening of the housing, and limits a rotation of the pedal arm in the opposite direction. The stopper has a groove extending from the contact face and being inclined downward in a gravity direction, when the housing is mounted to the vehicle and when the contact face of the stopper contacts the edge of the housing.

A foreign matter adhering to the contact face can be fallen into the groove from the contact face. The foreign matter is not caught between the stopper and the housing, so that a gap is restricted from being generated between the contact face of the stopper and the edge of the housing. The pedal arm can return to a totally-closed position by a biasing force of the spring when the driver does not press the pedal arm. As a result, when the vehicle is braked, a signal indicating the totally-closed position is input into an ECU of the vehicle from a rotation angle sensor. The ECU can control appropriately the operation state of the engine, so as to brake the vehicle.

According to an example of the present invention, the groove has a first side opening in the contact face, and a second side opening in a wall face of the stopper, in the gravity direction. The wall face of the stopper is located outside of the stopper when the contact face contacts the edge. Therefore, a foreign matter falling into the groove from the contact face can be discharged through an opening of the groove located on the outer wall face of the stopper. The foreign matter is not accumulated in the groove. The first side and the second side may be defined in a groove extending direction extending from the contact face to the outer wall face.

According to an example of the present invention, the groove has a bottom face extending from the contact face to the outer wall face, and the bottom face is inclined downward in the gravity direction when the housing is mounted to the vehicle and when the contact face contacts the edge. Therefore, the foreign matter can be moved downward in the gravity direction, and is discharged out of the stopper.

According to an example of the present invention, the bottom face of the groove is defined on the same plane as an outer wall of the pedal arm. Therefore, it is unnecessary to define a groove in the pedal arm. The groove of the stopper can be defined in the stopper without decreasing a rigidity of the pedal arm.

According to an example of the present invention, the groove is defined to separate the contact face into a first part and a second part in a rotation axis direction of the pedal arm, and an area of the first part is approximately equal with an area of the second part. Therefore, when the pedal arm is totally closed, a load of the spring is equally applied to the first part and the second part. Thus, the pedal arm is restricted from being inclined with respect to the rotation axis, so that the totally-closed position of the pedal arm can be secured.

According to an example of the present invention, the contact face has a curved surface protruding toward the edge of the opening of the housing. Therefore, a foreign matter adhering to the contact face of the stopper can be easily fallen into the groove, compared with a case where the contact face has a flat shape. Thus, the foreign matter can be restricted from being caught between the contact face and the edge.

According to an example of the present invention, the groove has a bottom face, and the bottom face has a curved surface recessed toward the pedal arm. Therefore, a foreign matter can be easily moved along the bottom face, compared with a case where the bottom face has a flat shape. Thus, the foreign matter can be restricted from being caught between the contact face and the edge.

According to an example of the present invention, the groove has a first side opposing to the contact face and a second side opposing to a bottom face of the groove, and a width of the second side of the groove is narrower than a width of the first side of the groove. Therefore, an opening of the groove is made larger on the upper side adjacent to the contact face, so that a foreign matter adhering on the contact face of the stopper can be easily fallen into the groove. Further, the foreign matter falling into the groove can be gathered on the bottom face, and the gathered foreign matters move along the bottom face downward in the gravity direction, so that the foreign matter can be easily discharged out of the stopper.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

A pedal device 1 will be described with reference to FIGS. 1-5. The pedal device 1 is mounted in a vehicle and has a pedal arm 20. An operation state of an engine of the vehicle is controlled when a driver of the vehicle presses the pedal arm 20. The pedal device 1 is an accelerator-by-wire type pedal device. A rotation angle of the pedal arm 20 is converted into an electrical signal by a rotation angle sensor 50 of FIG. 3, and the signal is input into an electronic control unit (ECU, not shown) of the vehicle. The ECU controls the operation state of the engine by controlling a throttle device or an injector, for example, based on the signal output from the rotation angle sensor 50 and speed data of the vehicle, for example.

Figure 2:
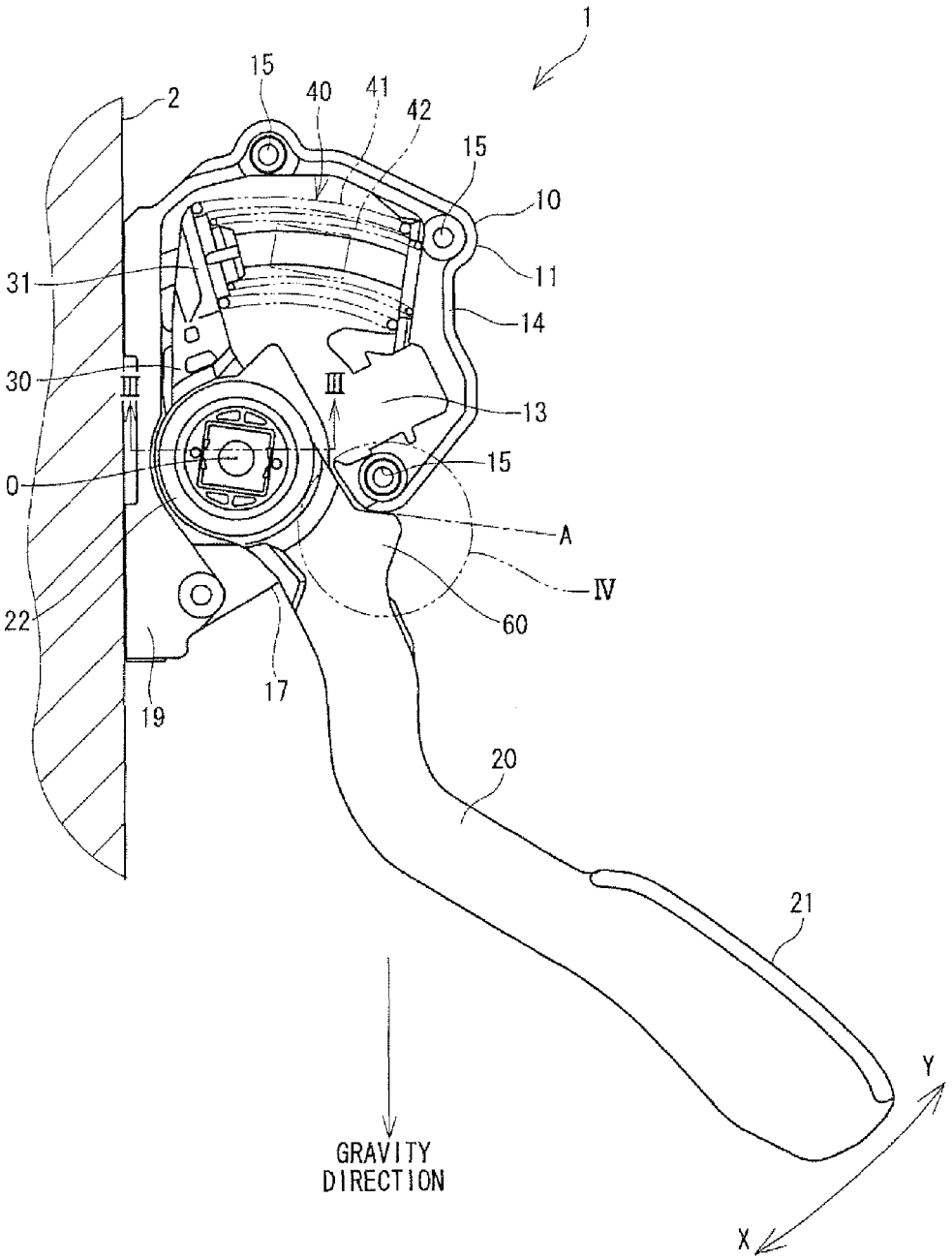
FIG. 2 is a cross-sectional view taken along line II-II of FIG. 1.

As shown in FIG. 2, the pedal device 1 includes a housing 10, a spring 40, a stopper 60 other than the pedal arm 20. The housing 10 is to be mounted to the vehicle. The pedal arm 20 is rotatably attached to the housing 10, and the driver of the vehicle presses the pedal arm 20 in a pressing direction. The spring 40 biases the pedal arm 20 in an opposite direction opposite from the pressing direction. The stopper 60 limits a rotation range of the pedal arm 20. The pressing direction is defined as X direction, and the opposite direction is defined as Y direction.

Figure 1:
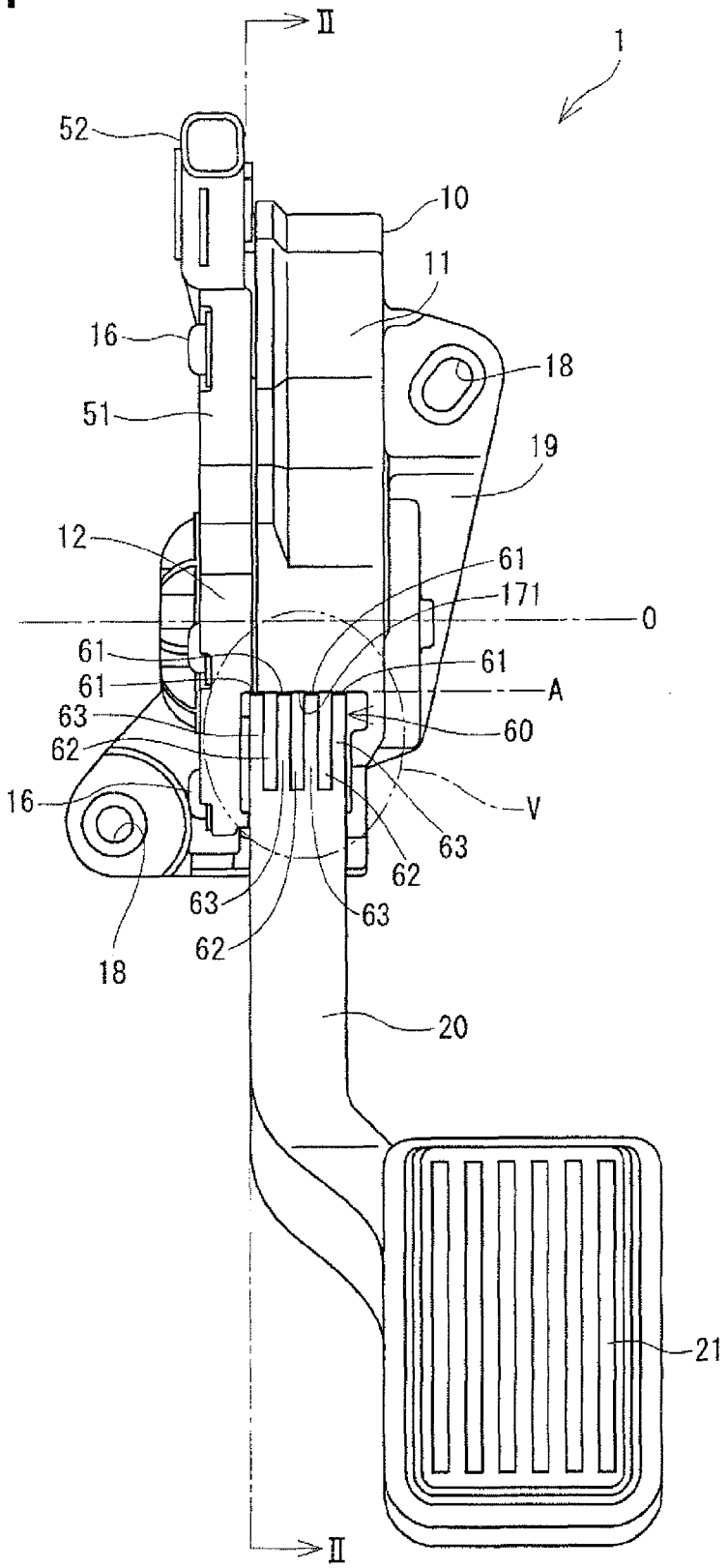
FIG. 1 is a plan view illustrating a pedal device according to a first embodiment.

As shown in FIGS. 1 and 2, the housing 10 includes a base member 11 and a covering 12 to cover the base member 11. The base member 11 has a plate 13 and a peripheral part 14 extending along an outer periphery of the plate 13. The covering 12 is attached to a bolt hole 15 defined in the peripheral part 14 by a bolt 16, and closes a side of the peripheral part 14 opposite from the plate 13. An accommodation space is defined between the base member 11 and the covering 12, and accommodates the pedal arm 20, a spring rotor 30, and the spring 40, for example. The pedal arm 20 is projected from the housing 10 through an opening 17 defined in the peripheral part 14. A bracket 19 having a bolt hole 18 is arranged on an outer side of the plate 13. The pedal device 1 is mounted to an inner wall 2 of the vehicle by inserting a bolt (not shown) in the bolt hole 18. A foot of the driver is located around the inner wall 2.

Figure 3:
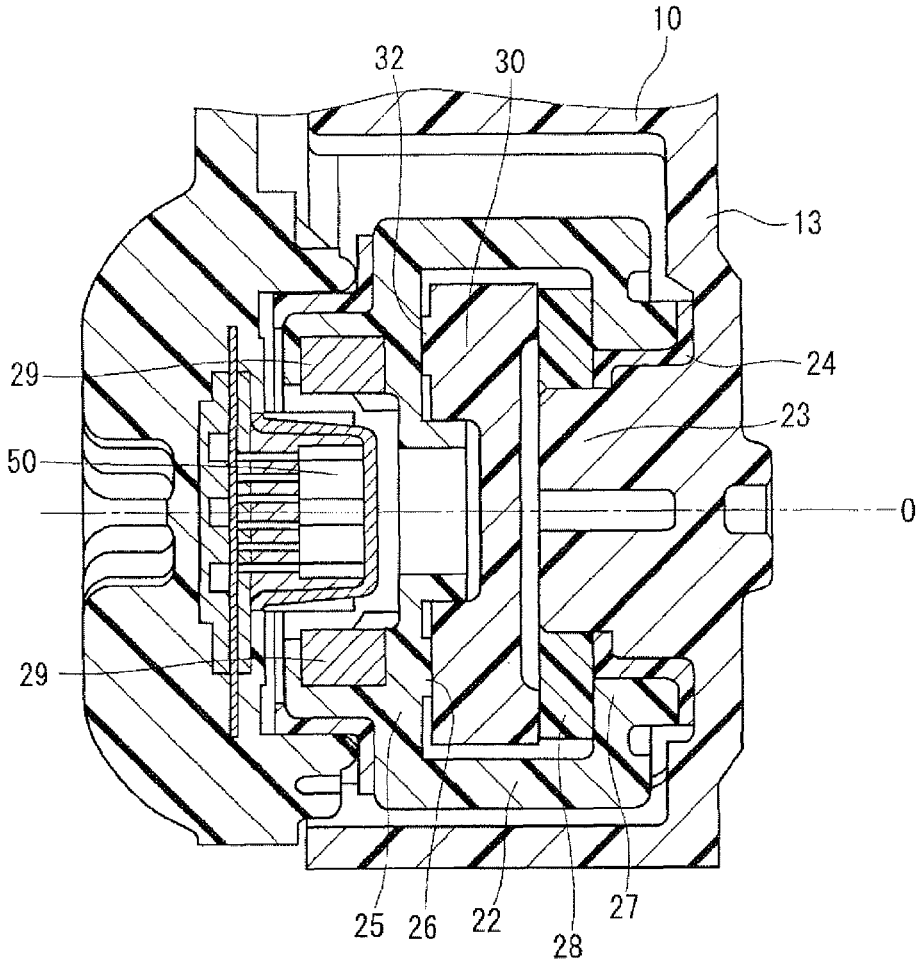
FIG. 3 is an enlarged cross-sectional view taken along line of FIG. 2.

The pedal arm 20 is made of resin, and has a controlling portion 21 which receives a driver's pressing force. The controlling portion 21 is located outside of the housing 10. As shown in FIG. 3, the pedal arm 20 has a based cylinder part 22 inside of the housing 10, and the cylinder part 22 has an approximately cylindrical shape. An approximately cylindrical shaft 23 protrudes from an inner wall of the plate 13 toward the covering 12. The cylinder part 22 is slidably mounted to the shaft 23 through a sliding ring 24. When the controlling portion 21 of the pedal arm 20 receives the driver's pressing force, the pedal arm 20 is rotated with respect to a rotation axis O.

The spring rotor 30 is arranged on an inner side of the cylinder part 22 in a radial direction. As shown in FIG. 2, the spring rotor 30 has a spring receiver 31 extending from an outer wall of the spring rotor 30 outward in the radial direction. The cylinder part 22 has an opening (not shown), and the spring receiver 31 protrudes from the opening in a direction opposite from the pedal arm 20. The spring 40 is arranged between the spring receiver 31 and an inner wall of the peripheral part 14 of the housing 10. The spring 40 is a double coil spring having an outside compression coil spring 41 and an inside compression coil spring 42 located inside of the outside spring 41. An end of the spring 40 is connected to the inner wall of the peripheral part 14, and the other end of the spring 40 is connected to the spring receiver 31.

As shown in FIG. 3, a swash plate 32 is arranged on a side of the spring rotor 30 opposing to the covering 12 in an axis direction. The swash plate 32 extends in a rotation direction of the rotor 30.

Another swash plate 26 is arranged on a side of a bottom 25 of the cylinder part 22 opposing to the spring rotor 30 in the axis direction. The swash plate 26 extends in the rotation direction of the rotor 30.

The spring rotor 30 and the pedal arm 20 are rotated together when the swash plate 32 of the spring rotor 30 and the swash plate 26 of the cylinder part 22 are engaged with each other. When the pedal arm 20 is rotated in the X direction or the Y direction in response to the driver's pressing force, the spring 40 applies an elastic force to the spring rotor 30 based on the rotation amount of the pedal arm 20.

The swash plate 32 of the spring rotor 30 and the awash plate 26 of the cylinder part 22 generate a force separating the spring rotor 30 and the pedal arm 20 from each other in the axis direction in response to a rotation force. A ring-shaped friction component 28 is disposed between a ring part 27 and an outer wall of the spring rotor 30 opposing to the plate 13. The ring part 27 extends inward from an inner wall of the cylinder part 22 in the radial direction. A frictional force generated between the spring rotor 30 and the friction component 28 and a frictional force generated between the ring part 27 and the friction component 28 are increased in accordance with the driver's pressing force and the elastic force of the spring 40. That is, the frictional forces are applied in a direction restricting the rotation of the pedal arm 20.

A pair of magnets 29 and a yoke (not shown) are inserted between the cylinder part 22 and the covering 12 in a molding time. The pair of magnets 29 oppose to each other in the radial direction. The rotation angle sensor 50 is disposed on inner side of the pair of magnets 29 and the yoke in the radial direction, and is not contact with the pair of magnets 29 and the yoke.

When the pedal arm 20 is rotated, a direction of a magnetic field generated by the pair of magnets 29 is changed, and a density of magnetic flux passing through a Hall element of the rotation angle sensor 50 is varied in a predetermined direction. The rotation angle sensor 50 outputs a voltage signal based on the density of magnetic flux. As shown in FIG. 1, a connector 52 is arranged on an end of a covering 51 of the sensor 50, and the signal output from the rotation angle sensor 50 is transmitted to the ECU of the vehicle through a terminal of the connector 52.

As shown in FIG. 2, the stopper 60 protrudes from an outer wall of the pedal arm 20 in the Y direction, and has an approximately triangle cross-section when cut in a direction perpendicular to the rotation axis O of the pedal arm 20. The stopper 60 is integrated with the pedal arm 20. A rotation of the pedal arm 20 in the Y direction is limited by the stopper 60 because a contact face 61 of the stopper 60 contacts an edge 171 of the opening 17 of the housing 10. The edge 171 corresponds to an outer periphery of the opening 17 of the housing 10. The pedal arm 20 is defined to have a totally-closed position A when the contact face 61 of the stopper 60 contacts the edge 171 of the housing 10.

Figure 4:
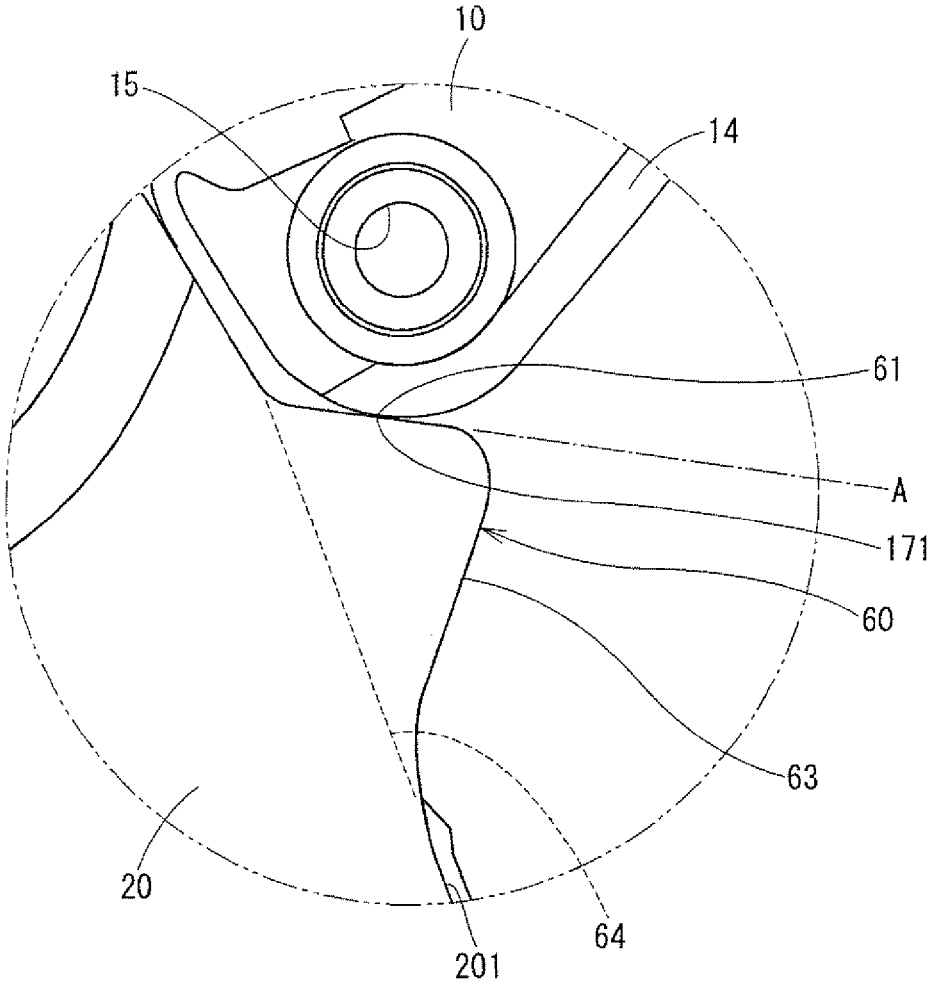
FIG. 4 is an enlarged view of a double-chained circle IV of FIG. 2.
Figure 5:
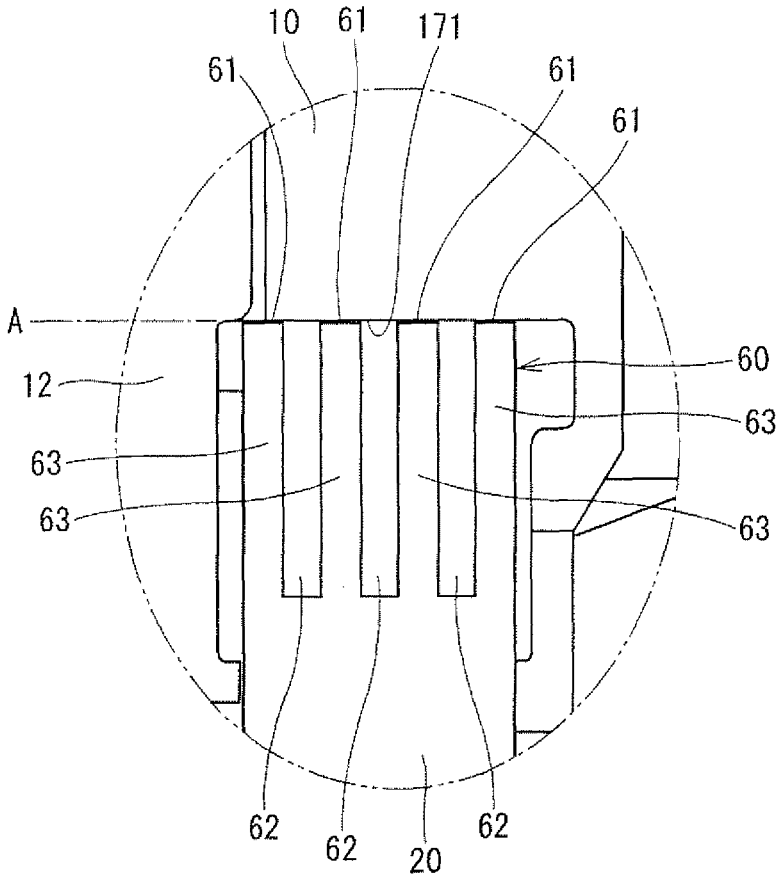
FIG. 5 is an enlarged view of a double-chained circle V of FIG. 1.

As shown in FIG. 5, the stopper 60 has three grooves 62, and the groove 62 has a slit shape. The groove 62 extends approximately perpendicular to the rotation axis O of the pedal arm 20. As shown in FIG. 4, when the pedal arm 20 is totally closed at the totally-closed position A, a side of the groove 62 in gravity direction opens in the contact face 61, and the other side of the groove 62 opens in an outer wall face 63 of the stopper 60 located adjacent and below the contact face 61 of the stopper 60. As shown in a broken line of FIG. 4, a bottom face 64 of the groove 62 is defined along an outer wall 201 of the pedal arm 20 opposing to the Y direction.

When the housing 10 is mounted to the inner wall 2 of the vehicle and when the pedal arm 20 is totally closed, the bottom face 64 of the groove 62 extending from the contact face 61 to the outer wall face 63 is inclined downward in the gravity direction. Therefore, the stopper 60 is constructed by four walls having the approximately triangle cross-section. The number of the grooves 62 is not limited to the three, and the number of walls constructing the stopper 60 is not limited to the four.

Because the three grooves 62 are defined in the stopper 60, so that the contact face 61 of the stopper 60 is divided into four parts. Intervals between the three grooves 62 are approximately equal with each other, and areas of the four contact faces 61 of the stopper 60 are approximately equal with each other. That is, an area of a divided part of the contact face 61 located on a first (left) side of the groove 62 is approximately equal with an area of a divided part of the contact face 61 located on a second (right) side of the groove 62, in a direction corresponding to the rotation axis O of the pedal arm 20. Therefore, when the pedal arm 20 is totally closed, a load of the spring 40 is equally impressed on the four contact faces 61.

An operation of the pedal device 1 is explained. As shown in FIG. 2, as the force of pressing the operation portion 21 of the pedal arm 20 by the driver is increased, the pedal arm 20 is moved in the X direction. At this time, the frictional force generated between the spring rotor 30 and the friction component 28 and the frictional force generated between the ring part 27 and the friction component 28 are increased, as the rotation angle of the pedal arm 20 is made larger. In this case, the frictional forces are applied so as to increase the biasing force of the spring 40. Therefore, when the pedal arm 20 is rotated in the X direction, the driver's pressing force is larger than the biasing force of the spring 40.

In contrast, as the force of pressing the operation portion 21 of the pedal arm 20 is reduced, the pedal arm 20 is moved in the Y direction. At this time, the frictional force generated between the spring rotor 30 and the friction component 28 and the frictional force generated between the ring part 27 and the friction component 28 are decreased as the rotation angle of the pedal arm 20 is made small. In this case, the frictional forces are applied so as to reduce the biasing force of the spring 40. Therefore, when the pedal arm 20 is rotated in the Y direction, the driver's pressing force is smaller than the biasing force of the spring 40. As a result, a predetermined hysteresis characteristic is generated in the rotation of the pedal arm 20. The rotation angle sensor 50 outputs a signal to the ECU of the vehicle based on the rotation angle of the pedal arm 20.

At a time of braking the vehicle, if a pressing force is applied to a brake pedal (not shown) by the driver, the pedal arm 20 returns to the totally-closed position A by the elastic force of the spring 40. At this time, if a foreign matter such as sand is caught between the contact face 61 of the stopper 60 and the edge 171 of the housing 10, the pedal arm 20 cannot return to the totally-closed position A. In this case, the rotation angle sensor 50 does not output the signal representing the totally-closed position A to the ECU. Therefore, the ECU keeps the operation state of the engine based on the rotation angle of the pedal arm 20.

According to the first embodiment, the stopper 60 limits the rotation of the pedal arm 20 in the Y direction, and has the groove 62 extending from the contact face 61 in the state of being inclined downward in the gravity direction, when the pedal arm 20 is totally closed. Thereby, a foreign matter adhering to the contact face 61 can be fallen into the groove 62, be moved downward in the gravity direction along the bottom face 64 of the groove 62, and be discharged out of the stopper 60 from the lower end of the groove 62 defined between the outer wall faces 63.

Therefore, the foreign matter is not accumulated in the groove 62, so that a gap is restricted from being generated between the contact face 61 of the stopper 60 and the edge 171 of the housing 10. The pedal arm 20 can return to the totally-closed position A when the driver does not press the pedal arm 20. As a result, the totally-closed position A of the pedal arm 20 is secured, and the signal indicating the totally-closed position A is input into the ECU from the rotation angle sensor 50 with reliability. The ECU can control appropriately the operation state of the engine by controlling fuel injection amount and throttle opening, for example. Thus, unintentional movement of the vehicle is not generated while the vehicle is braked.

The areas of the four contact faces 61 are approximately equal with each other. Therefore, when the pedal arm 20 is totally closed, the load of the spring 40 is equally applied to the four contact faces 61. Thus, the pedal arm 20 is restricted from being inclined with respect to the rotation axis O, so that the totally-closed position A of the pedal arm 20 can be secured.

Second Embodiment

Figure 6:
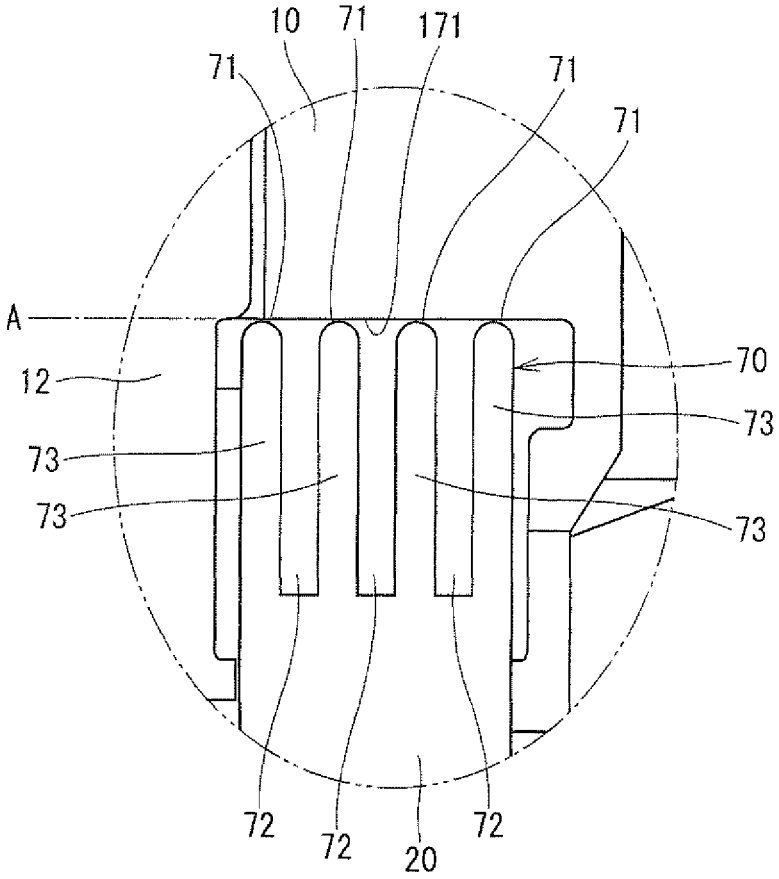
FIG. 6 is an enlarged view of a pedal device according to a second embodiment.

A second embodiment will be described with reference to FIG. 6. As shown in FIG. 6, four contact faces 71 of a stopper 70 respectively have a curved surface protruding toward the edge 171 of the housing 10. Therefore, a foreign matter adhering to the contact face 71 of the stopper 70 can easily fall into a groove 72. Thus, the foreign matter can be restricted from being caught between the contact face 71 and the edge 171, so that the pedal arm 20 can return to the totally-closed position A when the driver does not press the pedal arm 20.

Third Embodiment

Figure 7:
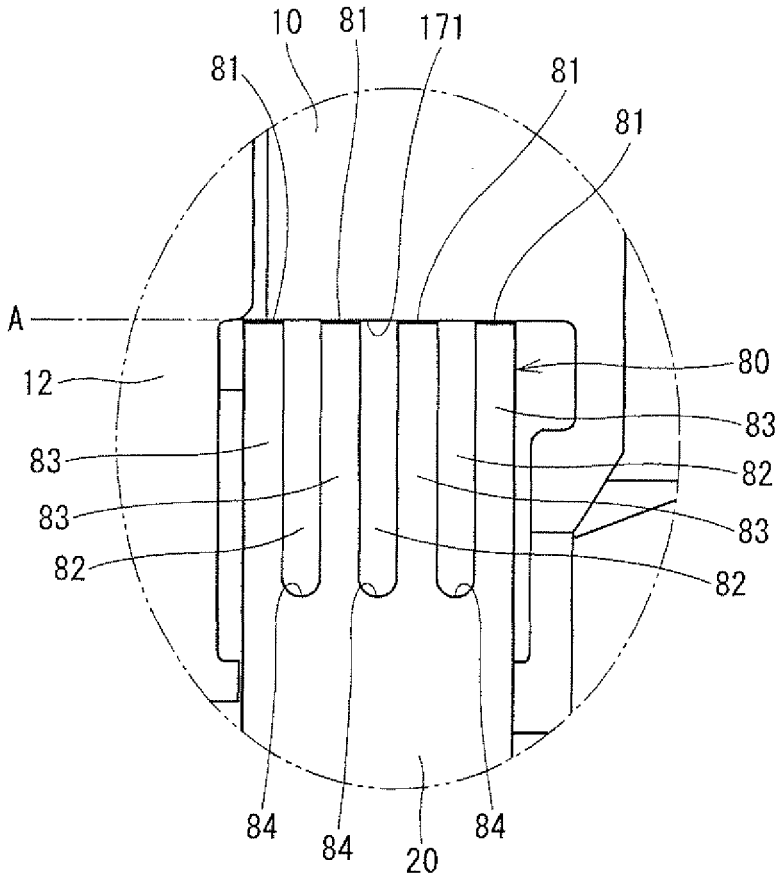
FIG. 7 is an enlarged view of a pedal device according to a third embodiment.

A third embodiment will be described with reference to FIG. 7. As shown in FIG. 7, a bottom face 84 of a groove 82 of a stopper 80 has a curved surface recessed toward the pedal arm 20. Therefore, a foreign matter falling onto the bottom face 84 can easily move downward in the gravity direction along the bottom face 84. That is, the foreign matter can be easily discharged out of the stopper 80. The foreign matter can be restricted from being accumulated on the bottom face 84, and the groove 82 is restricted from being filled with the foreign matters.

Fourth Embodiment

Figure 8:
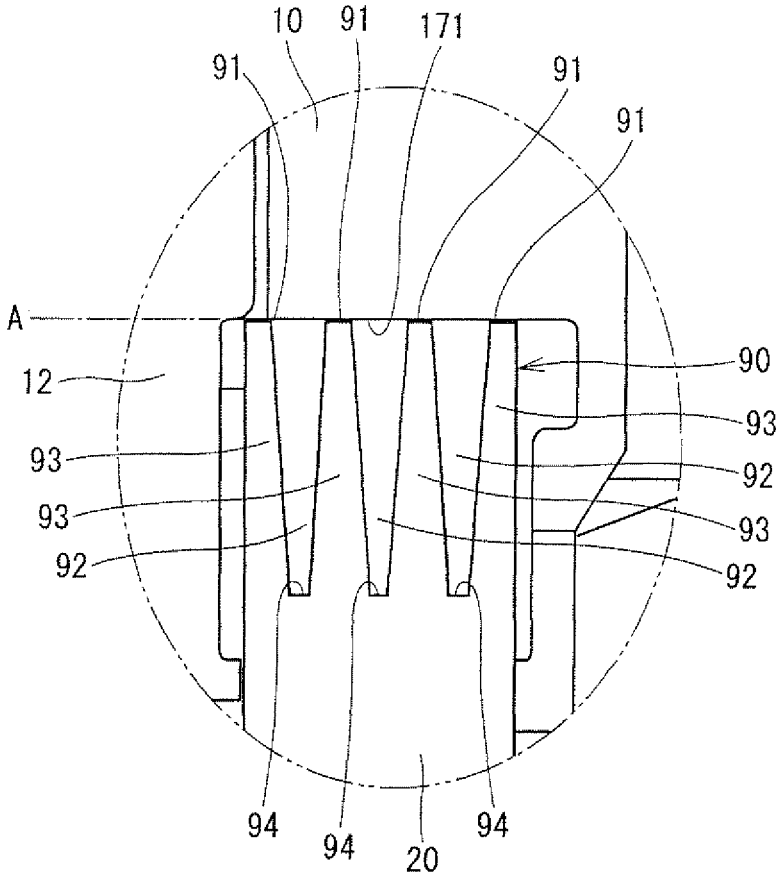
FIG. 8 is an enlarged view of a pedal device according to a fourth embodiment.

A fourth embodiment will be described with reference to FIG. 8. As shown in FIG. 8, a width of a lower part of a groove 92 of a stopper 90 adjacent to a bottom face 94 is made narrower than a width of an upper part of the groove adjacent to a contact face 91. Therefore, an opening of the groove 92 is made larger on the upper side adjacent to the contact face 91, so that a foreign matter adhering on the contact face 91 of the stopper 90 can easily fall into the groove 92. Further, the foreign matter falling into the groove 92 moves along an inclined face of the groove 92 downward in the gravity direction, so that the foreign matter can be easily discharged out of the stopper 90. Thus, the foreign matter can be restricted from being accumulated in the groove 92, and the groove 92 is restricted from being filled with the foreign matters.

Other Embodiment

The pedal device 1 is used for operating an accelerator of the vehicle. Alternatively, the pedal device 1 may be used for operating a brake of the vehicle.

The stopper 60, 70, 80, 90 is not limited to have the approximately triangle cross-section. Alternatively, the stopper may have an approximately rectangular parallelepiped shape or cylinder shape.

Such changes and modifications are to be understood as being within the scope of the present invention as defined by the appended claims.

What is claimed is:

1. A pedal device comprising:

a housing to be mounted to a vehicle;

a pedal arm rotatably supported by the housing and to be pressed by a driver of the vehicle in a pressing direction, the pedal arm passing through an opening of the housing;

a biasing portion biasing the pedal arm in an opposite direction opposite from the pressing direction; and a stopper having a contact face that contacts an edge of the opening of the housing to limit a rotation range of the pedal arm in the opposite direction, wherein the stopper is defined by a protrusion protruding from an outer wall of the pedal arm in said opposite direction, and wherein a groove is defined in the protrusion such that the groove extends from the contact face and is inclined downward in a gravity direction when the contact face of the stopper contacts the edge of the housing, wherein the groove has a first side opening in the contact face of the stopper, a second side opening in an outer wall face of the stopper, the outer wall face of the stopper being located adjacent and below the contact face of the stopper, and a bottom face extending from the contact face to the outer wall face, wherein the bottom face is inclined downward in the gravity direction when the contact face contacts the edge of the housing, and wherein the bottom face is defined on the same plane as an outer wall of the pedal arm.

2. The pedal device according to claim 1, wherein the groove is defined to separate the contact face into a first part and a second part in a rotation axis direction of the pedal arm, and an area of the first part is approximately equal with an area of the second part.

3. The pedal device according to claim 1, wherein the contact face has a curved surface protruding toward the edge of the housing.

4. The pedal device according to claim 1, wherein the bottom face has a curved surface recessed toward the pedal arm.

5. The pedal device according to claim 1, wherein the groove has a first side opposing the contact face and a second side opposing a bottom face of the groove, and a width of the second side of the groove is narrower than a width of the first side of the groove.

6. The pedal device according to the claim 1, wherein the protrusion defining the stopper has an approximately triangle cross-section when cut in a direction perpendicular to a rotation axis of the pedal arm.

7. The pedal device according to the claim 1, wherein the protrusion defining the stopper protrudes in said opposite direction with respect to a longitudinal axis of the pedal arm to define the contact face that contacts the edge of the opening of the housing and an outer wall face that is inclined with respect to said contact face, and said groove is defined to extend through said protrusion from said contact face to said outer wall face.

8. The pedal device according to the claim 7, wherein the pedal device comprises a plurality of grooves that are defined to extend through said protrusion.

9. The pedal device according to the claim 1, wherein the groove extends approximately perpendicular to a rotation axis of the pedal arm.

10. The pedal device according to claim 1, wherein the groove is defined inside all of the protrusion.

11. The pedal device according to claim 1, wherein the groove has a curved shape corresponding to a curved shape of the protrusion.

12. The pedal device according to claim 1, wherein the contact face is approximately perpendicular to a direction of gravity when the pedal device is mounted to the vehicle.

13. The pedal device according to claim 1, wherein the edge of the opening of the housing is an outer periphery of the opening of the housing.

* * * * *